US008672570B2

(12) United States Patent
Jollet et al.

(10) Patent No.: US 8,672,570 B2
(45) Date of Patent: Mar. 18, 2014

(54) APPLICATOR FOR APPLYING A COSMETIC COMPOSITION TO HUMAN KERATINOUS MATERIALS

(75) Inventors: Frederic Jollet, Cressonsacq (FR); Virginie Orliac, Saint-Denis (FR); Marcel Sanchez, Paris (FR)

(73) Assignee: L'Oreal, Paris (FR)

( * ) Notice: Subject to any disclaimer, the term of this patent is extended or adjusted under 35 U.S.C. 154(b) by 643 days.

(21) Appl. No.: 12/883,438

(22) Filed: Sep. 16, 2010

(65) Prior Publication Data

US 2011/0076085 A1 Mar. 31, 2011

Related U.S. Application Data

(60) Provisional application No. 61/247,173, filed on Sep. 30, 2009.

(30) Foreign Application Priority Data

Sep. 18, 2009 (FR) ..... 09 56430

(51) Int. Cl.
*A46B 11/08* (2006.01)

(52) U.S. Cl.
USPC ..... 401/2; 401/1

(58) Field of Classification Search
USPC ..... 401/1, 2, 49; 132/117, 221
See application file for complete search history.

(56) References Cited

U.S. PATENT DOCUMENTS

| | | | | |
|---|---|---|---|---|
| 4,875,792 | A * | 10/1989 | Canada | 401/283 |
| 7,883,286 | B2 * | 2/2011 | Thiebaut | 401/78 |
| 2007/0286831 | A1 | 12/2007 | Kamada et al. | |

FOREIGN PATENT DOCUMENTS

| | | | |
|---|---|---|---|
| EP | 1 621 101 | A1 | 2/2006 |
| EP | 1 955 610 | A2 | 8/2008 |
| JP | A-2006-169229 | | 6/2006 |
| WO | WO 02/43521 | A1 | 6/2002 |
| WO | WO 2006/043544 | A1 | 4/2006 |

OTHER PUBLICATIONS

French Search Report issued in French Patent Application No. 0956430 on Jul. 20, 2010 (with translation).

* cited by examiner

*Primary Examiner* — David Walczak
(74) *Attorney, Agent, or Firm* — Oliff PLC

(57) ABSTRACT

An applicator for applying a cosmetic composition to human keratinous materials, the applicator including a base having a reception zone and an electric heater element having two opposite sides; and an applicator unit that includes a support that extends along a longitudinal axis, that is fastened in removable manner on the reception zone, and that carries a mass of cosmetic composition that presents an application face that is suitable for coming into contact with keratinous materials; the mass of composition having a greatest dimension that is less than 40 mm, extending on only one side of the electric heater element, and the support with the casted mass of composition being fastened in a removable manner on the reception zone.

14 Claims, 9 Drawing Sheets

100
14
14
P
W
201
4
3
201
5
2
202
202
7
1
X 100
204
P
201
4
201

208
100
P
4
206
201
201

100
P
4
W
201
201

1
7
202
5
202
4
W
100

1
7
219
100

218

100
100
215
7
1
216
1
223
α
2

100

APPLICATOR FOR APPLYING A COSMETIC COMPOSITION TO HUMAN KERATINOUS MATERIALS

FIELD OF THE INVENTION

The present invention provides an applicator for applying cosmetic composition to human keratinous materials, in particular the eyelashes or the eyebrows, the lips, the skin, for example the eyelids, or nails, the applicator including an electric heater element. The cosmetic composition may be a makeup product or a care product.

BACKGROUND OF THE INVENTION

US application No. 2007/0286831 discloses a mascara applicator including a heater member, in which applicator the composition is in the form of strips or balls that are deposited on the heater member while said heater member is in a housing. Feed means comprising a piston, a cylinder, or a feed screw are provided to bring the composition onto the heater member. The composition is in contact with numerous mechanical parts, and that may reduce reliability and/or cause the composition to pick up undesirable particles.

Application EP 1 621 101 discloses an applicator including mascara in the form of a coiled strip that a user may bring into contact with a heater member of the applicator. Applying composition may turn out to be tricky, with it being necessary for the user both to apply the composition to the keratinous materials and to unroll the strip of composition so as to renew the composition coming into contact with the heater member.

Application EP 1 955 610 discloses an applicator endpiece that includes a makeup composition for the eyelashes, and that is mounted by being fitted onto a heater presenting the shape of a finger, the composition extending over the entire periphery of the applicator endpiece.

PCT application WO 2006/043544 discloses an applicator device for applying a cosmetic composition, the device including a unit that is mounted on a reception zone of a base, facing a heater member, and receiving the composition for application once in place on the base.

JP 2006/169229 discloses a heated mascara applicator.

OBJECT AND BRIEF SUMMARY OF THE INVENTION

There exists a need to enable a cosmetic composition to be applied to keratinous materials by means of an applicator that is relatively simple to construct, relatively reliable, hygienic, and practical to use.

The invention seeks to satisfy this need, and in exemplary embodiments it achieves this by means of an applicator for applying a cosmetic composition to human keratinous materials, the applicator comprising:

- a base including a reception zone and an electric heater element having two opposite sides; and
- an applicator unit comprising a support that extends along a longitudinal axis, that is fastened in removable manner on the reception zone, and that carries a mass of cosmetic composition that presents an application face that is suitable for coming into contact with keratinous materials;

the mass of composition extending on only one side of the electric heater element.

The mass of composition may have a greatest dimension that is less than 40 millimeters (mm), or even less than 30 mm, or even less than 20 mm.

The support may be configured in such a manner that once the applicator unit is fastened on the reception zone, the mass of composition is stationary relative to the base until it has been used up.

The mass of composition is carried by the support before fastening the applicator unit on the reception zone. The mass of composition may be fastened on the support, e.g. by being cast into contact therewith.

By means of the invention, prior to application, the composition is put into place on the applicator easily by mounting the support on the base. The composition may possibly be put into place while holding the support in a zone that does not have any composition, and thus without the composition coming into contact with the fingers, thereby reducing the risks of soiling or contaminating the composition.

Furthermore, removably fastening the support on the base makes it easy to change composition, and may make it easier to clean the base since the remaining unused composition may adhere to the support and be removed with said support.

The presence of the support also paves the way for novel possibilities of formulating the composition, since weaker mechanical strength of the composition may be compensated by it adhering to the support, which may then act as reinforcement, where appropriate.

Finally, the support may be configured so as to exert a combing action on the eyelashes. The composition may be distributed on the support in predefined manner during manufacture, so as to optimize makeup application, with good reproducibility of effects. The support makes it possible to control the transfer of heat to the composition and to any portions in relief that may possibly be used for combing and/or for application.

The base may include a housing that defines the reception zone, at least in part. Such a housing may improve the retention of the support on the base, and the transfer of heat towards the composition.

Preferably, for application to the eyelashes, the reception zone extends substantially parallel to the longitudinal axis of the base, e.g. opening out laterally. In a variant, the reception zone extends transversally to said axis.

When the composition is for application to the lips, the reception zone may be inclined relative to longitudinal axis of the base.

The electric heater element may open out onto the reception zone so as to come into contact with the mass of composition, or into its proximity, coming into the direct proximity of the electric heater element, or even into contact therewith, may enable the mass of composition to be heated more rapidly, and heating to be better controlled.

By way of example, the mass of the composition may lie in the range 10 milligrams (mg) to 100 mg, which quantity may be adapted to a single use, for example. The composition may be mascara, for example.

The composition may also be a lip product, an eyeliner or a makeup or care product for nails. The composition, for example when it is a lip product, may be in contact with a coating of flocking. The coating may be present on the support before the composition is deposited on the support. The coating of flocking may extend parallel to the longitudinal axis of the base or perpendicular to the end face of the base when the latter is chamfered and the end face extends obliquely. The support may present, for example when the composition is a lip product, the shape of a removable cup. When the composition is an eyeliner, the composition may extend along a narrow strip, for example less than 2 mm or 1 mm wide, over the support.

The support may comprise two legs at its longitudinal ends, configured to be fastened in corresponding housings of the base, for example by snap-fastening. The support may comprise an incurved portion extending between the two fixation legs, for example convex toward the outside or concave toward the outside.

The orientation of the support may be substantially parallel to the longitudinal axis of a handling portion of the applicator, or may be substantially perpendicular there to. The base receiving the application unit may be hinged so as to enable variation in the angle that the support makes with the handling portion.

When the composition is mascara, the quantity of composition makes it possible to make-up one or two sets of eyelashes, for example. The user may put the support into place with the appropriate quantity of composition suitable for making-up one or two sets of eyelashes, may apply the composition, may add finishing touches, and then may proceed to removing the support, with a view to replacing it on next use with a support carrying an intact mass of composition. The support may possibly be removed after the applicator unit has cooled sufficiently for all of the composition to have solidified.

The composition may be solid, for example. The term "solid" means a composition that does not flow under the effect of gravity at 20° C. The composition may possibly be stringy when hot.

The mass of composition need not be a strip that is folded in half or coated on cores.

The support may be fastened on the reception zone by various means, e.g. by snap-fastening, by sliding connection, by magnetization, or by force-fitting, with such fastening means being relatively simple to implement.

For example, on its bottom face, the support may include two profiled portions in relief for sliding over the base, e.g. two rims that are directed towards each other and that are configured to slide over the base. The support and the base may be configured to create a hard point marking the end of insertion of the applicator unit on the base.

The support may include ridges or a coating of flocking that extend over the mass of composition, at least in part. When the applicator is applied to macroscopic keratinous'fibers such as the eyelashes or the eyebrows, the ridges make it possible to comb said fibers, thereby defining combing means. Furthermore, the ridges may define a bearing zone enabling a user to remove the support more-easily from the reception zone, e.g. by sliding it over the base.

The support may include two to fifteen ridges, for example.

The offset between two adjacent ridges may lie in the range 0.2 mm to 1 mm, for example.

The ridges may extend transversally or parallel to the longitudinal axis of the support.

The ridges may be of the same height. In a variant, two ridges may have heights that are different, the heights of the ridges may vary in non-monotonic manner on going from one extreme ridge to the other, for example. By way of example, the heights of the ridges present an extremum on going from one extreme ridge to the other, the extremum being a maximum or a minimum, for example. Thus, in an example, the envelope surface defined by the tops of the ridges is outwardly-concave, e.g. with a radius of curvature that is adapted to the curvature of a set of eyelashes.

The support may include applicator elements that project, the applicator elements being made integrally with the support, for example, or, in a variant, being fitted on said support. The applicator elements may be disposed between the ridges, e.g. in at least one row, parallel to the longitudinal axis of the support. The above-mentioned ridges may carry applicator elements.

For an application to the eyelashes, the applicator elements may be useful for separating the eyelashes loaded with composition and for defining combing means for combing the eyelashes. The temperature of the applicator elements may be lower than the temperature of the surface of the mass of composition coming into contact with the eyelashes. In a variant, the applicator elements are at temperature that is higher than the temperature of the surface of the mass of composition coming into contact with the eyelashes, thereby making it possible to smooth the composition deposited on the eyelashes, for example.

The applicator elements may be in the form of teeth. In order to obtain the desired temperature profile on the applicator, it is possible to act on the thicknesses of material and on the configuration of the electric heater element.

The support may be an open-work grid, at least in part, in particular in order to enable the composition to be in direct contact with the heater element. Thus, the support may comprise a frame surrounding the mass of composition, the frame comprising two sides that are interconnected via the above-mentioned ridges, for example.

The support may be configured to prevent contact between the keratinous materials and the electric heater element. Thus, where appropriate, the support may protect the keratinous materials from direct contact with the heater element, and that may be useful when the temperature of said heater element is relatively high.

By way of example, the reception zone is configured in such a manner that the support may be mounted on the reception zone from the front of the base, e.g. by sliding it. In a variant, the reception zone may be configured in such a manner that the support may be mounted on the reception zone in a direction that is substantially perpendicular to the longitudinal axis of the base, e.g. from above.

The electric heater element may be flexible, presenting a shape that is generally flat or curved, for example. An elastically-deformable return element may be present so as to exert a return force on the electric heater element, the return element being constituted by a foam that acts as a spring, for example. The elastically-deformable return element may urge the electric heater element to bear against the support and/or the composition when the applicator unit is fastened on the base, thereby guaranteeing heat transfer by contact. Where appropriate, the presence of a return element may also be useful in contributing to preventing the applicator unit from moving on the base. Thus, the return element may exert a thermal function and/or a mechanical function.

The base may be arranged so as to detect the presence or absence of the applicator unit, and the heater element may be prevented from operating in the absence of the applicator unit. When the support is in place on the base, it may interact with a detector that is present on the base, for example.

The base may also be arranged to recognize the applicator unit, and to adapt the heating temperature to said applicator unit, for example. By way of example, recognition may be performed by means of the shape of the support that may interact with a detector carried by the base.

The support may be made entirely out of a thermoplastic material, or out of metal. In exemplary embodiments of the invention, the heater element includes a flexible synthetic film that does not have a metal coating and the support is made out of metal.

In a variant, the heater element includes a metal coating and the support is made out of a thermoplastic material or out of metal.

The contact surface between the composition and the support is greater than or equal to 10 square millimeters ($mm^2$), for example.

The support may be made by molding in a mold. The thermoplastic material may include an inorganic filler, where appropriate. The support may be stationary relative to the base between it being put into place and it being removed.

Where appropriate, the support is in the form of a dish having a bottom that is closed, for example.

In a variant, the support is in the form of a sleeve carrying the mass of composition on one of its faces.

At least one portion of the outer surface of the support is subjected to a treatment that enables a particular shape to be imparted to said portion.

The applicator may also include a dish, e.g. a metal dish, in the reception zone of the base, and the applicator unit may be engaged in said dish. The dish may possibly be removable in order to enable it to be cleaned or replaced.

The applicator makes it possible to select one particular temperature from amongst a plurality of temperatures, where appropriate.

A same applicator may receive different application units comprising different compositions, for example for eyelashes on one hand and nails on the other hand, or compositions for applying to a same zone but of different colors. An applicator may be packaged with at least two supports carrying different compositions.

Other exemplary embodiments of the invention also provide a method of loading a support with cosmetic composition, said support being suitable for being mounted in removable manner, in particular at a later date, in a reception zone of a base of an applicator including an electric heater element, wherein:

the composition is put into contact with the support; and the composition is caused to adhere to the support by raising or lowering the temperature of the composition.

By way of example, the composition is put into contact with the support once it has been pre-heated to a temperature that is higher than its melting point. The composition adheres to the support while cooling.

In a variant, the composition is deposited in contact with the support in pellet or powder form, and the composition is caused to adhere to the support by raising the temperature of the composition so as to cause it to melt. Then, while cooling, the composition coagulates and adheres to the support.

The applicator may be made available to the consumer as the base together with a plurality of supports, each carrying a measured quantity of composition, constituting a corresponding number of applicator units. After using up the composition present on one support, the user may replace the support by a new support. In particular, the base may be made available together with applicator units within a single package.

Within a single package in particular, the base may equally well be made available with a plurality of supports carrying different compositions, and the user may select a support from amongst all of the available supports as a function of the composition that the user wishes to use.

By way of example, the different compositions may be of different colors or may present different rheological properties. By way of example, the different compositions that are made available may lead to more or less makeup being applied, and/or to a greater or smaller lengthening effect.

In particular when the appearance of compositions that are present on the corresponding supports do not enable the user to distinguish between them easily, the supports may be made with identifiers, making it possible to distinguish between them. By way of example, the supports may be made with different colors, with a corresponding composition being associated with each color. The user may thus select the support of color corresponding to the composition that the user wishes to apply.

The supports may be single-use supports, i.e. once the composition present on the support has been used, the support is of no further use. In a variant, the supports may be designed so as to be reused by the user after replenishing the composition.

For example, a support may be made available to the user with an accessory that enables the user to cause a new mass of composition to adhere to the support. By way of example, the accessory presents a housing that is suitable for receiving the support that is to be reused, and a container containing the composition that is to be caused to adhere to the support, possibly together with metering means. The user may place the accessory in a microwave oven or the accessory itself may heat up and the quantity of composition placed initially in contact with the support may melt and adhere thereto. In a variant, a composition is cast while hot into contact with the support, and the composition is left to cool.

Different supports made available to consumers may be packaged individually, or, in a variant, in a single package. By way of example, the supports may be presented in strings, e.g. being connected to one another via breakable bridges of material. This may make it easier to manufacture applicator units.

Within a single package in particular, it is also possible to make available to the user, supports that are loaded with a single composition but that present different portions in relief, e.g. including more or fewer projecting applicator elements or including ridges that are oriented differently, e.g. in order to comb the eyelashes to a greater or lesser extent during application and to apply more or less makeup.

The composition may be a composition that is stringy when hot, and the electric heater element may bring the composition to a temperature that is sufficient to cause it to melt and to enable strings of composition to be formed, in particular at the ends of the eyelashes.

Alternatively, the composition need not be stringy when hot, and heating the composition may cause the composition to adhere more strongly to the eyelashes, thereby making it easier to obtain a deposit that is more glossy, or even making it possible to use compounds that are not suitable for application while cold.

The heating temperature of the electric heater element lies in the range 50° C. to 75° C., for example.

Where appropriate, the applicator may include a vibration source for subjecting the reception zone to vibration.

The composition may present a melting point that is greater than or equal to 50° C., e.g. close to 54° C.

By way of example, the composition is selected so as to be capable of being heated several times to a temperature of at least 90° C., without deteriorating.

The reception zone may be stationary relative to a handle portion of the applicator, or, in a variant, it may be movable. By way of example, such mobility may make it easier to remove the applicator unit that is stationary relative to the handle portion for example, such that moving the reception zone enables the applicator unit to be ejected. The applicator may equally well include an ejector making it possible to eject the support from the reception zone. This may avoid contact between the user's fingers and the composition. The ejector may be actuated by a pushbutton that is pushed by the user.

Where appropriate, the applicator may include applicator elements that do not form part of the applicator unit, e.g. on a side of the base remote from the reception zone. The applicator elements may be carried by the base in non-removable manner, or, in a variant, may be carried in removable manner, thereby enabling the user to change the applicator elements, e.g. as a function of the makeup effect that the user wishes to achieve. The invention is not limited to a composition for application to the eyelashes or the eyebrows. The composition may equally well be a lipstick, a lip gloss, or a foundation, for example.

The support need not have any cellular, fibrous, or porous substrate such as a foam, a felt, a fabric, or a non-woven fabric.

In a variant, the applicator unit may include such a substrate, e.g. fastened at its periphery to a more rigid frame. The composition may impregnate the substrate, at least in part.

Other exemplary embodiments of the invention also provide an applicator for applying a cosmetic composition to human keratinous materials, the applicator comprising:

a base including an electric heater element and a reception zone; and an applicator unit comprising a support that extends along a longitudinal axis, that is fastened in removable manner on the reception zone, and that carries a mass of cosmetic composition that presents an application face that is suitable for coming into contact with keratinous materials;

the mass of composition extending over less than a complete circle about the longitudinal axis of the support.

Such an applicator may present any one of the above-mentioned characteristics.

Other exemplary embodiments of the invention also provide an applicator for applying a cosmetic composition to human keratinous materials, the applicator comprising:

a base including a reception zone and an electric heater element having two opposite sides; and an applicator unit comprising a support that extends along a longitudinal axis, that is fastened in removable manner on the reception zone, and that carries a mass of cosmetic composition that presents an application face that is suitable for coming into contact with keratinous materials;

the mass of composition extending on only one side of the electric heater element, and being carried by the support before fastening the applicator unit on the reception zone;

the support including combing means.

Such an applicator may further present any one of the above-mentioned characteristics.

Other exemplary embodiments of the invention also provide an applicator for applying a cosmetic composition to human keratinous materials, the applicator comprising:

a base including a reception zone and an electric heater element having two opposite sides; and an applicator unit comprising a support that extends along a longitudinal axis, that is fastened in removable manner on the reception zone, and that carries a mass of cosmetic composition that presents an application face that is suitable for coming into contact with keratinous materials;

the mass of composition extending on only one side of the electric heater element, and being carried by the support before fastening the applicator unit on the reception zone;

the composition being mascara or a composition configured for application to lips, skin or nails.

Such an applicator may further present any one of the above-mentioned characteristics.

BRIEF DESCRIPTION OF THE DRAWINGS

The invention can be better understood on reading the following description of non-limiting embodiments thereof, and on examining the accompanying drawings, in which.

MORE DETAILED DESCRIPTION

Figure 1:
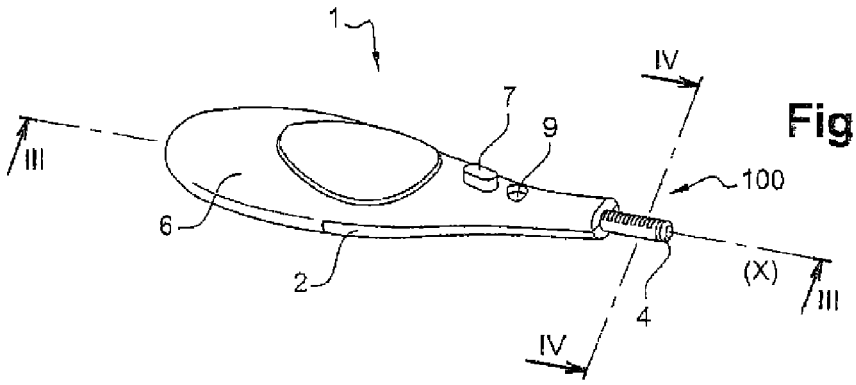
FIG. 1 is a diagram showing an applicator in a first embodiment of the invention.

FIGS. 1 to 4 show an applicator 1 in a first embodiment of the invention. The applicator 1 comprises a base 2 including an electric heater element 3 and an applicator unit 100 that is mounted in removable manner on the base 2 at a reception zone 5 thereof. In the embodiment described, the reception zone 5 extends parallel to the axis X of the base 2, but this could be otherwise.

The applicator unit 100 includes a support 4 that carries a mass of composition P.

In the embodiment shown, the base 2 extends along a longitudinal axis X and the reception zone 5 is formed in the distal portion thereof. The base 2 defines a handle portion 6 that may house various elements, as described below.

By way of example, the base 2 comprises two half-shells 2*a* and 2*b* that are assembled together and that are made out of plastics material.

As shown, the base 2 may include an on/off button 7 that is used to operate and power an electric heater element 3 from an independent energy source 8, thereby transmitting heat to the applicator unit 100.

The base 2 may include an operation indicator 9, in particular a light-emitting diode.

As shown, the base 2 may house a control circuit 10 for controlling the electric heater element 3, and, by way of example, the control circuit 10 comprises one or more electronic components, in particular a microcontroller, making it possible to regulate the temperature of the electric heater element 3.

The base 2 may also include a temperature sensor, preferably disposed at the electric heater element 3 and connected to the control circuit 10.

By way of example, the independent electrical energy source 8 comprises at least one optionally-rechargeable battery, e.g. two 1.5 volt (V) round batteries connected in series.

The handle portion 6 may extend around the energy source 8.

An access flap (not shown) may be provided in order to remove or replace the energy source 8. In a variant, the half-shells 2*a* and 2*b* are separated.

The electric heater element 3 may be made in various ways, and may include a resistive electrical conductor that is coiled or in the form of a track. By way of example, the heater element 3 may be flexible, e.g. comprising a substrate 31 made of polyimide and carrying a resistive track.

Figure 4:
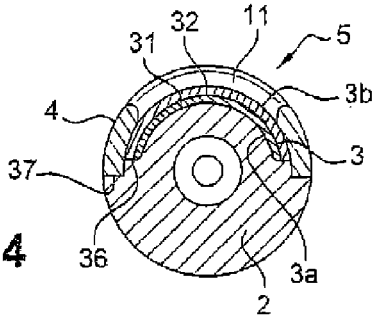
FIG. 4 is a cross-section view on IV-IV of the applicator shown in FIG. 1.

The electric heater element 3 presents two opposite sides 3*a* and 3*b*, and may present a shape that is substantially plane or that is curved in cross-section at least in part, as shown in FIG. 4.

The cross-section of the electric heater element 3 may also present a dome shape.

In the embodiment in FIGS. 1 to 4, the electric heater element 3 includes a metal coating 32 that is made out of stainless steel or out of anodized aluminum, for example.

Figure 2:
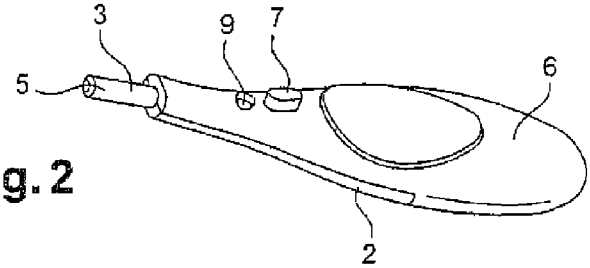
FIG. 2 is a view of the applicator shown in FIG. 1, in the absence of an applicator unit.
Figure 3:
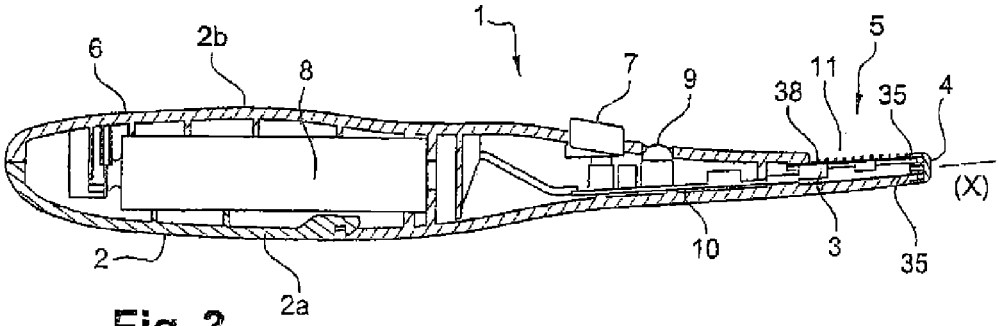
FIG. 3 is a longitudinal section view on of the applicator shown in FIG. 1.

As shown in FIG. 2, the electric heater element 3 may define the reception zone 5, at least in part. By means of the metal coating 32 in the embodiment shown, the electric heater element 3 may come to face at least a portion of the applicator unit 100 when said unit is fastened in the reception zone 5.

As shown, the reception zone 5 may define a housing 11 that is configured to receive the applicator unit 100. By way of example, the housing 11 extends parallel to the axis (X) of the base, possibly opening out to the sides of the base.

By way of example, the housing 11 is open at its distal end 35, being closed by the distal portion of the support 4 when the removable unit 100 is mounted on the base, and may include lateral edges 36 in which there may be formed a step 37 that co-operates with fastener means of the support 4, as described below.

The proximal end 38 of the housing 11 may be defined by an extension of the half-shell 2*b* beneath which the proximal portion of the support 4 bears when the removable unit 100 is mounted on the base 2.

The electric heater element 3 may define a portion of the bottom wall of the housing 11, in particular by means of the metal coating 32, or it may be disposed to face said portion of said bottom wall. As shown in FIG. 4, when the electric heater element 3 is curved, the bottom wall of the housing 11 may also be curved.

In general, by way of example, the regulated electric heater element 3 presents a nominal power lying in the range 0.5 watts (W) to 2 W, e.g. lying in the range 0.75 W to 1 W, e.g. about 0.8 W, and makes it possible for the support, when not loaded with composition, to reach a temperature that is greater than 50° C., or even greater than 60° C., in less than 30 seconds (s), e.g. a temperature that is greater than 50° C., or even greater than 60° C., in less than 20 s, for an ambient temperature of 20° C.

By way of example, the heater element 3 makes it possible to reach a temperature of about 65° C. in about 18 s, and a temperature of 105° C. in less than one minute when it is powered by at least two 1.5 V batteries in series.

The electric heater element 3 may be arranged in such a manner as to present, in operation, a power density lying in the range 0.8 watts per square centimeter ($W/cm^2$) to 1.2 $W/cm^2$.

Figure 5:
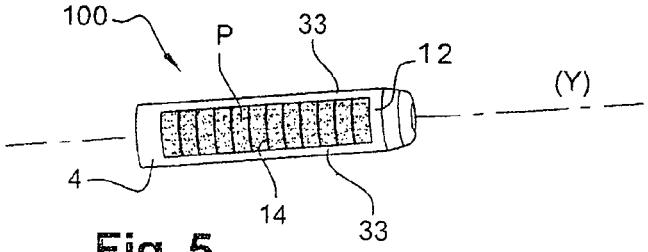
FIG. 5 shows an applicator unit in isolation.

FIG. 5 shows an applicator unit 100 in isolation. The support 4 may extend along a longitudinal axis Y that may be parallel to the longitudinal axis X of the base 2 when the applicator unit is mounted on said base.

As shown, the support 4 may comprise a frame comprising two lateral branches 33 that are interconnected at their proximal and distal ends via the proximal and distal portions of the support 4.

The support 4 may include ridges 14 that may be oriented transversally to the axis Y, as shown in FIG. 5, or in some other way, as described below.

The ridges 14 may interconnect the lateral branches 33 on the side of the applicator unit 100 that is remote from the heater element 3, when the applicator unit 100 is in place on the base 2.

By way of example, the support 4 may be made out of plastics material, possibly filled with inorganic particles or fibers, e.g. of metal oxides, glass fibers or powder, or carbon black, and is made in particular out of a polyolefin such as polyethylene or polypropylene, or, in a variant, out of non-polyolefinic materials such as acrylonitrile butadiene styrene (ABS) or polyoxymethylene (POM).

In a variant, and in particular when the heater element 3 does not have a metal coating 32, the support 4 may be made out of metal, e.g. out of aluminum, brass, silver, or stainless steel.

The bottom wall of the support 4 may optionally be open.

As shown, the mass of composition P may extend over less than one complete turn around the axis Y of the support 4, e.g. bearing via a face that is remote from the application face, against the bottom wall of the support 4 that is positioned to face the electric heater element 3 when the applicator unit 100 is in place on the base 2.

The mass of composition P thus extends on only the side 3*b* of the electric heater element.

In the embodiment in FIG. 4, the mass of composition does not extend facing the face 3*a* of the heater member when the applicator unit is in place on the base 2.

By way of example, the support 4 carries a mass of composition lying in the range 10 mg to 100 mg, e.g. in the range 30 mg to 70 mg, e.g. about 50 mg.

The mass of composition may have a greatest dimension that is less than 40 mm, or even less than 30 mm, or even less than 20 mm.

The composition P may be solid at 20° C.

By way of example, the cosmetic composition P is a makeup composition for the eyelashes, presenting a property that varies as a function of temperature, e.g. being stringy when hot. By way of example, it is a composition that includes at least one reversible polymer. In particular, the stringy characteristic may be $d_{max} \geq 5$ mm, being determined in particular by the protocol described in paragraphs [0120] to [0127] of application EP 1 955 610.

The composition may be mascara, for example.

In a variant, the composition may be for application to the lips or may equally well be a makeup composition for the skin, e.g. a foundation.

The support 4 may possibly be deformed elastically after fastening on the base 2, and the deformation may contribute to holding it in place.

Figure 6:
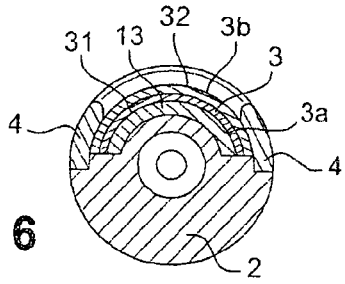
FIG. 6 shows a variant of the FIG. 4 applicator.
Figure 7:
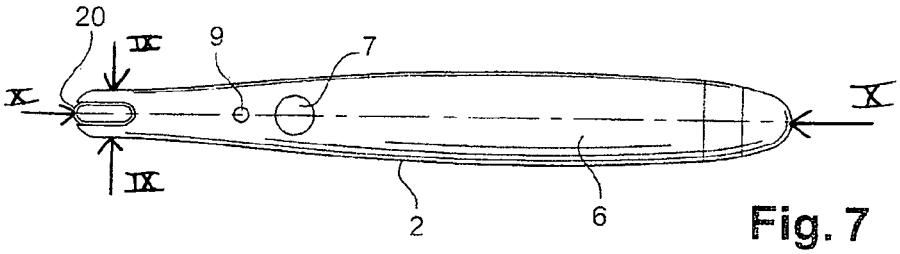
FIGS. 7 and 8 are diagrams showing an applicator in another embodiment of the invention.

Means of extracting the support 4 from the housing 11 may be provided, e.g. an ejector pushbutton or lever that is actuated by the user.

Where appropriate, a resilient return element 13 may urge the electric heater element 3 to bear against the applicator unit 100, as in the embodiment in FIG. 6. By way of example, the resilient return element 13 is a block of elastically-deformable material, such as a cellular material, that is placed beneath the electric heater element 3. The heater element 3 is movable and/or may deform, and may, under the effect of thrust produced in this way, be pressed against the applicator unit 100.

FIGS. 7 to 10 show an applicator 1 in another embodiment of the invention.

Figure 8:
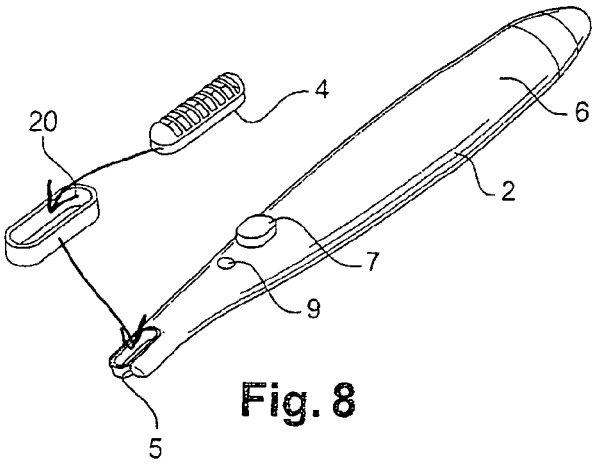
Figure 9:
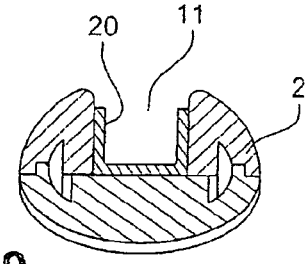
FIG. 9 is a cross-section on IX-IX of the applicator shown in FIG. 7.
Figure 10:
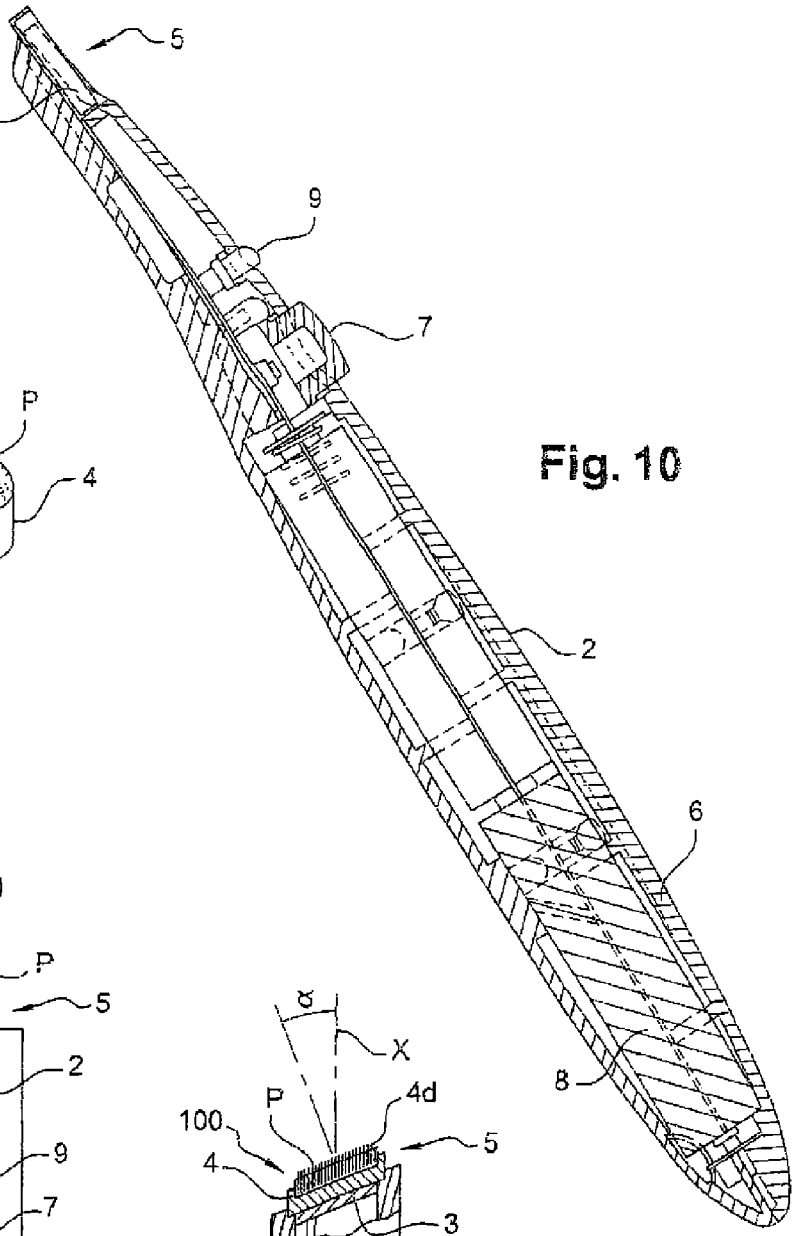
FIG. 10 is a longitudinal section on X-X of the applicator shown in FIG. 7.

As can be seen in FIG. 8, the support 4 may be received in a dish 20. By way of example, the dish is made out of thermoplastic material, but may also be made out of metal in order to promote heat transfer. The dish 20 may be useful in reducing the risk of composition running out from the applicator during heating, and may also be useful during manufacture of the applicator unit.

The dish 20 may be hollow, or it may include a closed bottom that, when the dish 20 is mounted in the reception zone 5, defines the bottom wall of the housing 11 receiving the applicator unit.

The dish 20 may be fastened in removable manner in the reception zone 5 so as to enable it to be removed, e.g. in order to replace it or to change the applicator unit. The dish 20 may also be made available to the user with the support 4, and may form part of the applicator unit 100.

Figure 11:
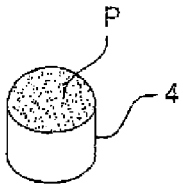
FIGS. 11 and 12 are diagrams showing another embodiment of the invention.

The support 4 may also be in the shape of a dish, as shown in FIG. 11.

In the embodiment in FIGS. 7 to 10, the bottom wall of the housing 11 is plane, but it could be of some other shape without going beyond the ambit of the present invention.

Figure 12:
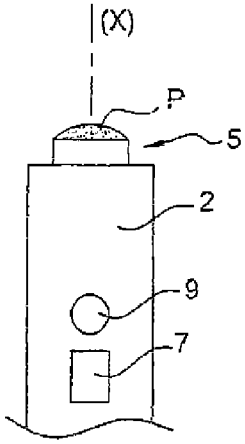

As shown in FIG. 12, an applicator unit 100 may be fastened on a reception zone 5 that extends generally transversally to the longitudinal axis X of the base 2. The applicator unit 100 may include a support in the shape of a dish. Such an applicator element may be suitable for applying a composition to the lips or the skin, for example.

Figure 12A:
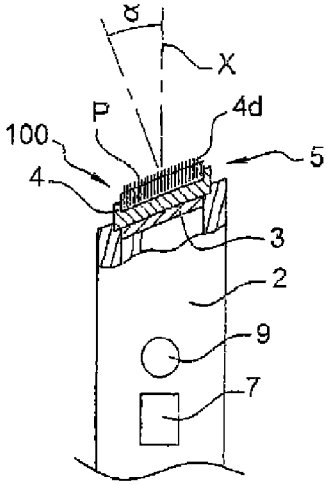
FIG. 12A is a view similar to FIG. 12, with a partial axial section, of a variant of the applicator.

FIG. 12A shows a variant of the applicator in which the support 4 comprises a coating of flocking 4*d*. The composition P is, for example, cast on the support 4 while the bristles 4*d* are already present thereon, for example glued on the bottom of a setback of the support receiving the composition.

The applicator may be chamfered, with an end face having on angle γ with axis X.

Flocking 4*d* may be oriented parallel to axis X, or may be at an angle γ with axis X or be oriented otherwise.

Another embodiment of a support 4 of the invention is described below with reference to FIGS. 13 to 15.

In the embodiment described, the support 4 is open-worked in part, and it includes portions in relief 21 for sliding in the reception zone 5 of the base 2, in particular co-operating with steps 37, so as to enable the support 4 to be fastened by sliding connection on the reception zone 5. As in the embodiment shown, the portions in relief 21 need not extend beneath the distal portion of the support 4.

Figure 13:
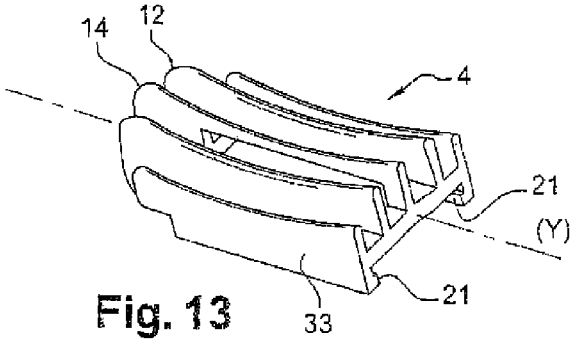
FIGS. 13 to 29 are diagrams showing examples of supports for supporting applicator units of the invention.
Figure 14:
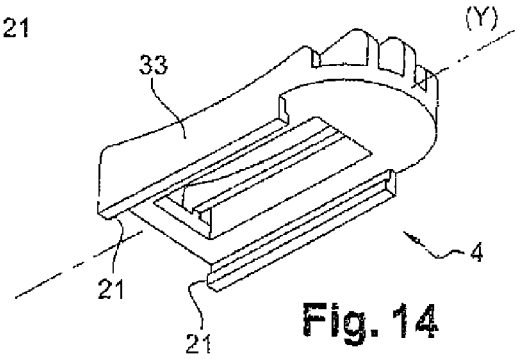
Figure 15:
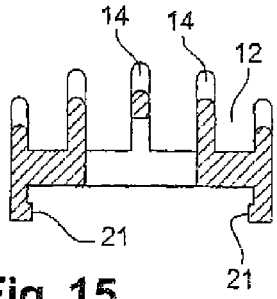
Figure 16:
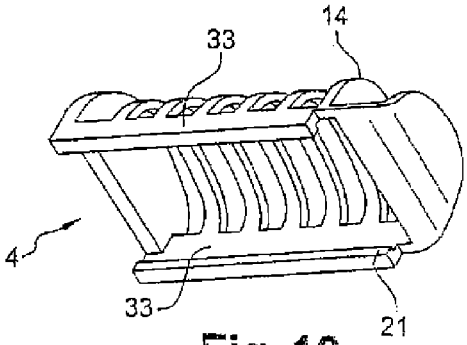

As can be seen in FIG. 15, which is a cross-section view of the support shown in FIGS. 13 and 14, the top face 12 of the support 4 may include a plurality of ridges 14 that extend parallel to the longitudinal axis Y of the support 4 over the entire length thereof, between its two longitudinal ends.

In the embodiment shown, the ridges 14 present heights that are different, the heights of the ridges possibly increasing towards a mid-plane.

Another embodiment of a support 4 of the invention is described below with reference to FIGS. 16 to 19.

In the embodiment under consideration, the ridges 14 extend perpendicularly to the longitudinal axis Y of the support 4, between the branches 33 of the support 4.

Figure 17:
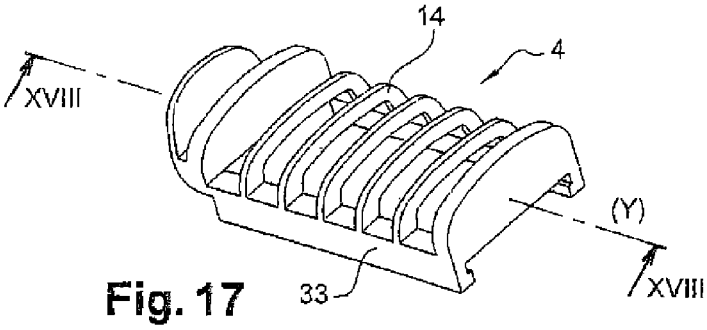
Figure 18:
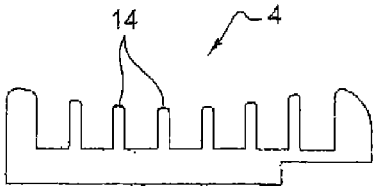
Figure 19:
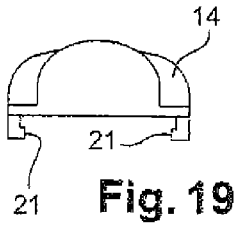

As can be seen in FIG. 18 that is a longitudinal section view on XVIII-XVIII of the support shown in FIG. 17, the ridges may present heights that vary from one end of the support to the other, in particular that pass via a minimum mid-way along the length of the support.

The tops of the ridges define an envelope surface that is generally outwardly concave.

FIGS. 20 to 25 show other embodiments of supports 4, in which the proximal end of the support 4 includes a fastener tab 25 for inserting into the base 2.

In the vicinity of its distal end, the support 4 may include a peg 26 for engaging in a corresponding recess that is formed in the reception zone 5.

In the embodiments in FIGS. 20 to 25, the ridges 14 extend perpendicularly to the axis Y, but, in a variant, they may extend parallel to the axis Y.

Figure 20:
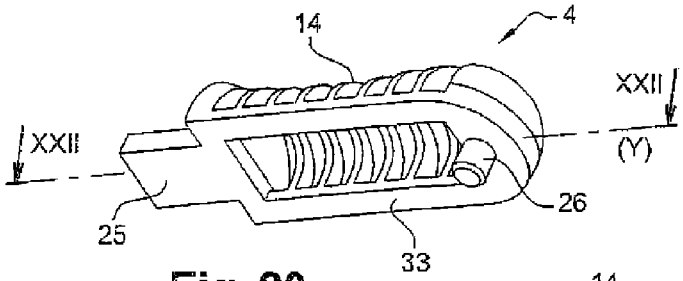
Figure 21:
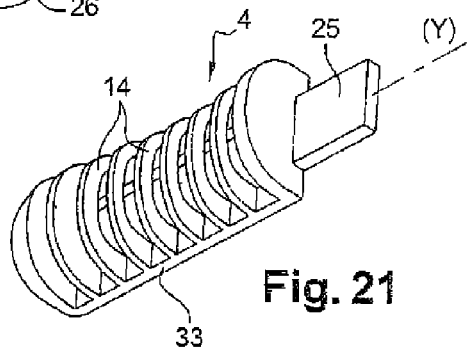
Figure 22:
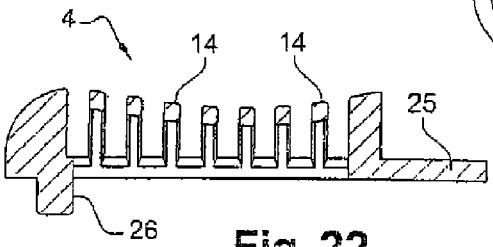

In the embodiment in FIGS. 20 to 22, the ridges 14 present heights that are different, their heights passing via a minimum on going from one extreme ridge to the other along the axis Y, as can be seen in FIG. 22 that is a longitudinal section view on XXII-XXII of the applicator shown in FIG. 20.

Figure 23:
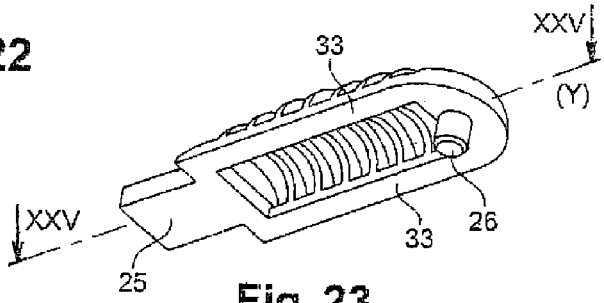
Figure 24:
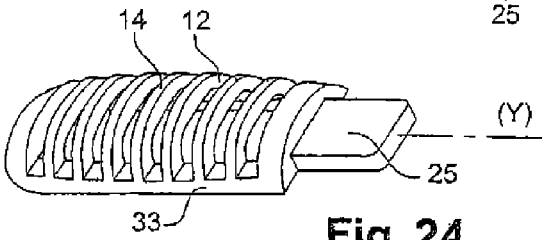
Figure 25:
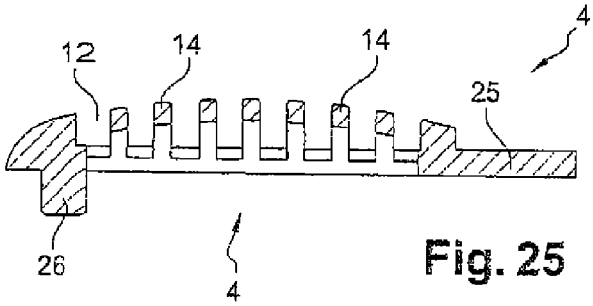

In the embodiment in FIGS. 23 to 25, the heights of the ridges pass via a maximum on going from one extreme ridge to the other along the axis Y, as can be seen in FIG. 25 that is a longitudinal section view on XXV-XXV of the applicator shown in FIG. 23.

Figure 26:
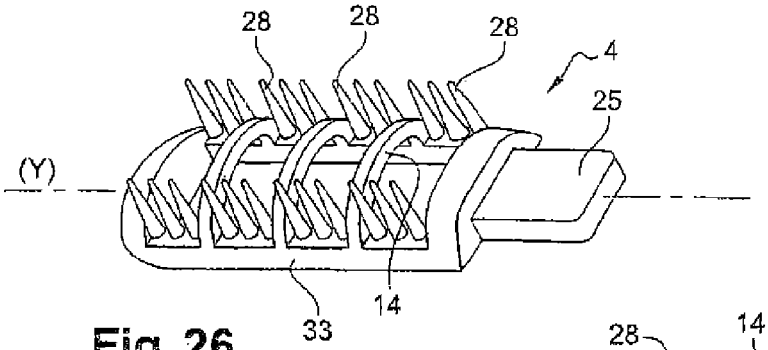

As shown in FIGS. 26 to 29, the support may include applicator elements 28. The applicator elements may be disposed on the branches. 33 of the support 4, as shown in FIG. 26.

When the support 4 is made out of thermoplastic material, the applicator elements 28 may optionally be made integrally with the remainder of the support 4.

In the embodiment shown in FIGS. 25 to 29; the applicator elements 28 are teeth that extend between the ridges 14. By way of example, the same numbers of applicator elements 28 are disposed between pairs of adjacent ridges 14.

Figure 27:
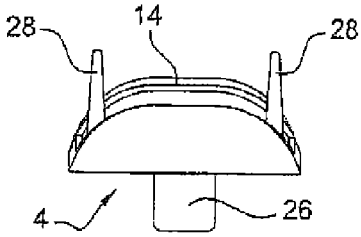

The applicator elements 28 may be disposed in rows that are parallel to the axis Y, and may project above the ridges 14, as can be seen in FIG. 27 that is an end view of the support shown in FIG. 26.

Figure 28:
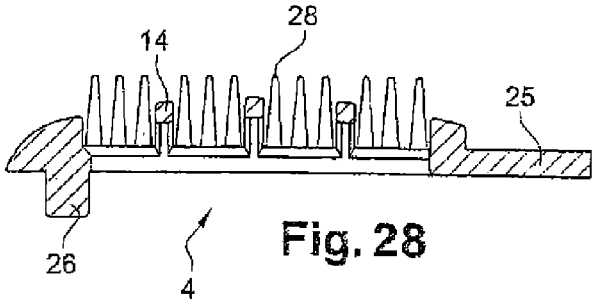
Figure 29:
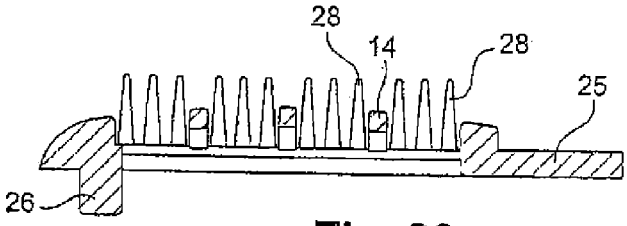

FIG. 28 is a longitudinal section view of the applicator shown in FIG. 26. FIG. 29 is a similar view of a variant having ridges 14 that are not as tall.

The applicator elements 28 may extend over the support 4 in two rows, each disposed on a branch 33 of the support 4.

Figure 30:
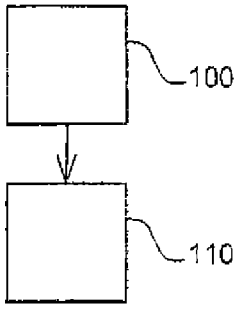
FIGS. 30 and 31 show methods of loading supports with composition, in implementations of the invention.

As shown in FIG. 30, in a step 100, a support 4 may be loaded with composition by putting the composition P into contact with the support 4 after being heated to a temperature that is greater than its melting point, e.g. 54° C. A measured quantity of composition P may be deposited inside the support 4. During a step 110, the temperature of the composition is lowered, e.g. by allowing it to rest or by forced cooling, so as to enable the composition to adhere to the material of the support 4.

Figure 31:
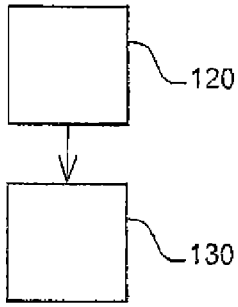

In a variant, as shown in FIG. 31, during a step 120, the composition that has been pre-packaged in pellet form or in powder form is deposited at ambient temperature in the support 4.

At a step 130, the temperature of the composition is raised to a temperature of at least 70° C., e.g. by passing the support on which the composition has been deposited into an oven, so that the composition P melts and then on coagulating adheres to the support 4, and in particular to the ridges 14.

Figure 32:
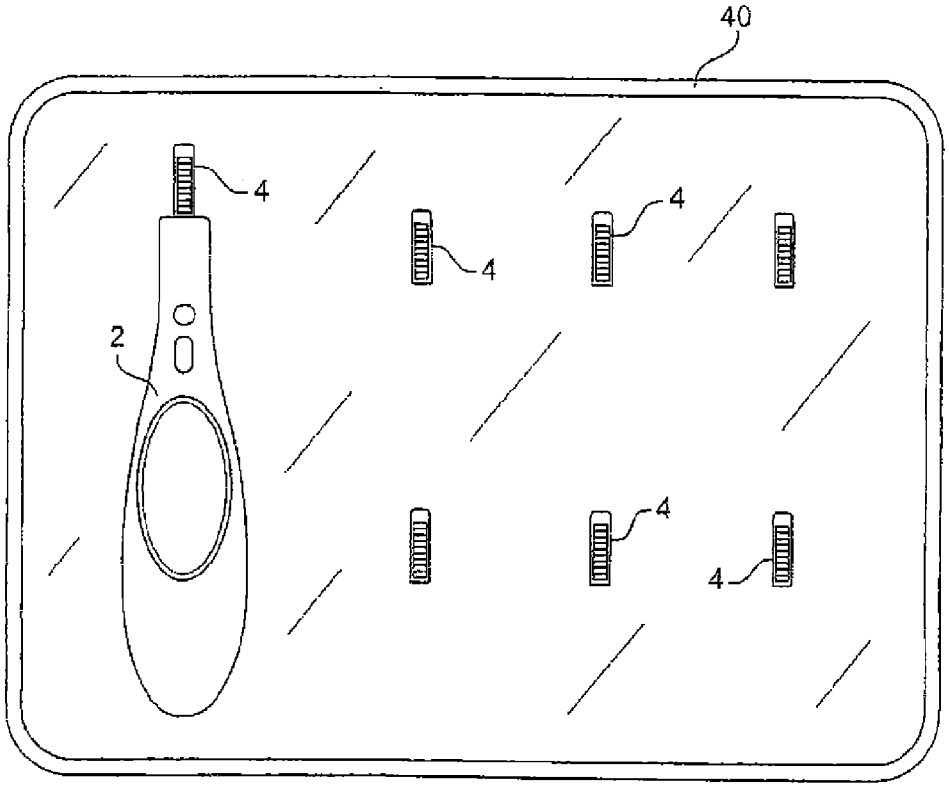
FIG. 32 shows a package comprising a base and a plurality of applicator units of the invention.

After the supports 4 have been loaded with composition, e.g. by the method described with reference to FIG. 30 or 31, they may be sold in a package 40, e.g. a blister pack, comprising a plurality of applicator units 100 and a base 2 onto which an applicator unit 100 is already fastened, where appropriate, as shown in FIG. 32. The applicator units may contain the same composition or different compositions.

Figure 33:
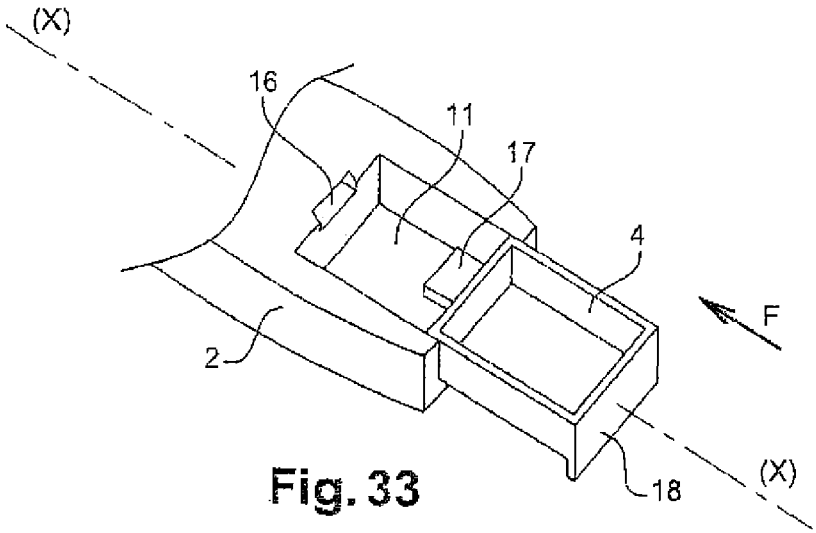
FIGS. 33 and 34 show examples of fastening an applicator unit in the reception zone of the base by snap-fastening.
Figure 34:
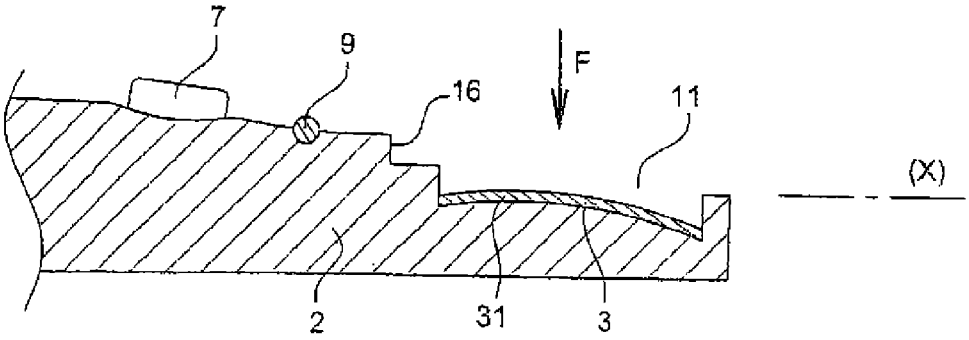

FIGS. 33 and 34 show, in very diagrammatic manner, examples of fastening the applicator unit on the base 2 by snap-fastening.

In the embodiment shown in FIG. 33, the reception zone 5 defines a housing 11 opening out at the distal end of the base 2 and having a bottom wall that is defined, in part, by the electric heater element 3. By way of example, the heater element 3 does not have a metal coating 32, and the support 4 is in the form of a metal dish. The support 4 may be inserted into the housing 11 in, the direction of arrow F, e.g. by a sliding movement.

As can be seen in FIG. 33, in which the composition P is not shown for the purpose of clarity, the housing 11 includes an opening 16 into which there may be engaged a retaining tab 17 for holding the support, for example. By way of example, the tab 17 may snap-fasten in the opening 16.

At its front end remote from the end carrying the retaining tab 17, the support 4 may also include a ridge 18 that comes to bear against the distal end of the base when the applicator unit is in place in the reception zone 5. The ridge 18 may make it easier to remove the applicator unit.

In the embodiment in FIG. 34, the housing 11 is closed at the distal end of the base 2 and presents a bottom wall that is convex. The applicator unit may be inserted into the housing 11 substantially perpendicularly to the longitudinal axis X of the base 2, via the top, in the direction of arrow F.

Figures 35, 36, 37, 38, 39, 40, 41, 42, 43:
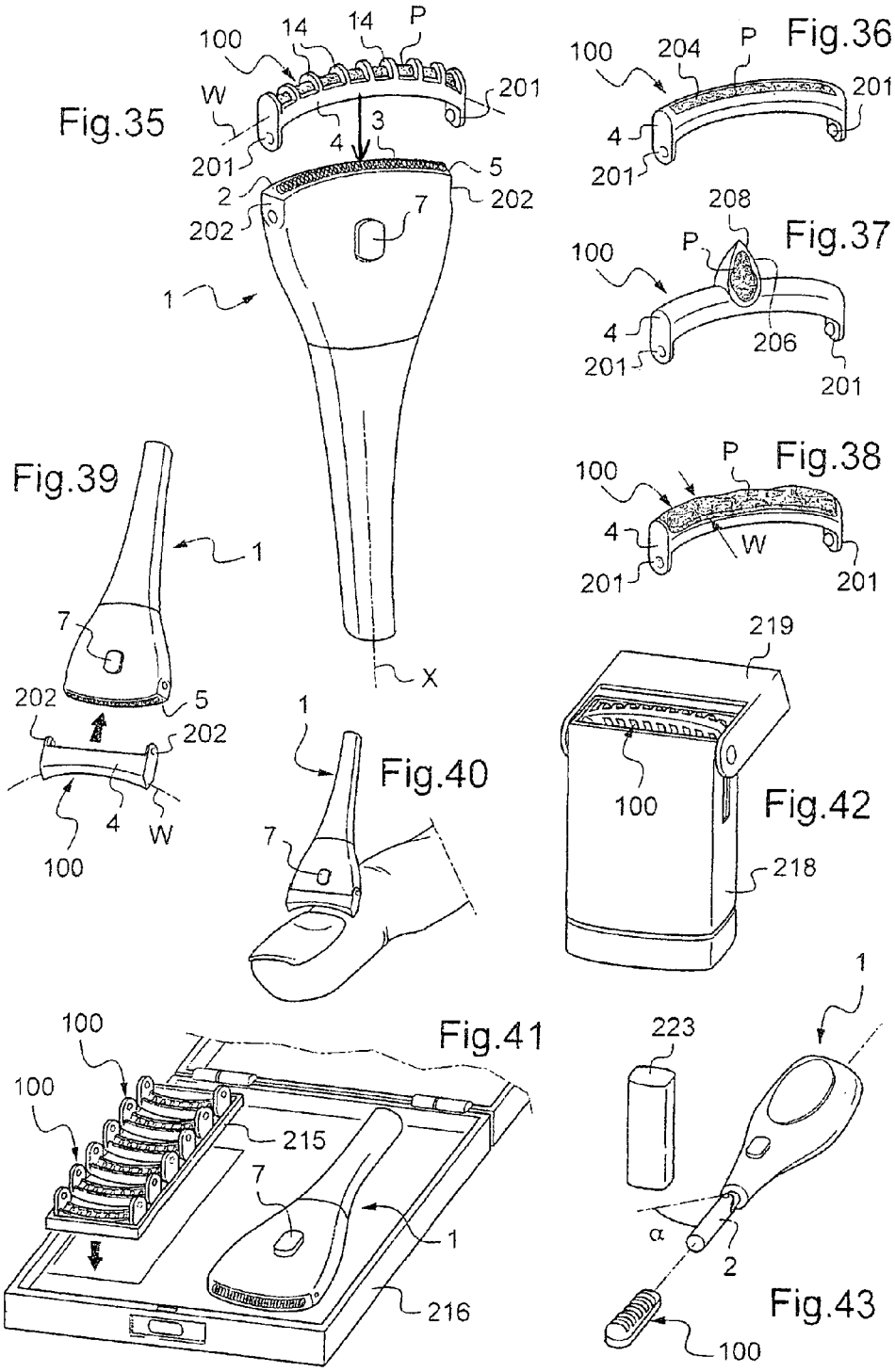
FIG. 35 shows a variant of the applicator.
FIGS. 36 to 38 show variants of application unit.
FIG. 39 shows another variant of applicator, configured for application to the nails.
FIG. 40 shows the applicator of FIG. 39 in use.
FIGS. 41 and 42 show a variant of packaging for the application units.
FIG. 43 shows another variant of applicator.

FIG. 35 shows a variant embodiment of the applicator 1.

The support 4 extends along a longitudinal axis W which may not be rectilinear, as shown, and may be provided at its longitudinal ends with fixation legs 201 configured to cooperate with corresponding housings 202 of the base of the applicator 1, for example, to snap-fasten in these corresponding housings.

The longitudinal axis W and the longitudinal axis X of the applicator 1 may extend in the same plane, axis W being for example convex toward the outside.

The ridges 14 may extend generally perpendicular to axis W.

The applicator 1 shown on FIG. 35 comprises ridges 14 and is particularly appropriate for application of composition P on the eyelashes or eyebrows.

In a variant embodiment, the support 4 is configured for application of the composition on the lips for example, and comprises a setback 204 which extends longitudinally and which is full of composition P. The support 4 may be flocked.

In the variant illustrated on FIG. 37, the support 4 comprises, in a central area, a protuberance 206 having one face carrying composition P, intended for application on the lips for example. The protuberance 206 may have a tapered distal end.

The support 4 according to the variant embodiment of FIG. 38 carries a composition which is, for example, an eyeliner and may extend longitudinally on the support 4, with a small width.

FIG. 39 shows an applicator 1 which receives an application unit 100 configured for application to the nails. This application unit 100 is elongate along a longitudinal axis W which is concave towards the outside, having curvature corresponding substantially to the nails.

The composition P is, for example, present on the support 4 substantially over its entire length.

The application of product on the nail is carried out by moving the applicator, provided with the application unit 100, along the nail, as shown in FIG. 40.

FIG. 41, shows the possibility of having many application units 100 disposed side by side inside a receptacle 215, which is for example received in a box 216 with the applicator 1.

In an exemplary embodiment, a same applicator receives a support selected among various supports 4 carrying compositions intended for use on different zones.

The application units 100 may also be packaged in a box 218 provided with a lid 219, for example a lid connected to the body of the box by a hinge.

The application units 100 may be stacked one on the other with means provided in the bottom of the box 218 to push the application unit 100 upward while the application units 100 are being taken out.

The base 2 of applicator 1 may have a fixed orientation relative to the handling portion of the applicator 1. In a variant, the base 2 may be configured to be adjusted with respect to the handling portion of the applicator 1, which allows the user to orient the base 2 of an angle $\alpha$ relative to the longitudinal axis of the handling portion of the applicator 1, as shown in FIG. 43. The applicator may comprise a cap 223 which is fastened on the base 2 between uses of the applicator 1.

In variants not shown, the applicator unit is fastened in the reception zone 5 by magnetization.

The invention is not limited to the embodiments shown. The characteristics of the various embodiments may be combined together within variants that are not shown.

The expression "comprising a" should be understood as meaning "comprising at least one", unless specified to the contrary.

What is claimed is:

1. An applicator for applying a cosmetic composition to human keratinous materials, the applicator comprising:
- a base including a reception zone and an electric heater element having two opposite sides; and
- an applicator unit comprising:
  - a support that extends along a longitudinal axis, and
  - a mass of cosmetic composition casted into contact with the support, wherein
    - the mass of composition presents an application face that is suitable for coming into contact with keratinous materials, has a greatest dimension that is less than 40 mm, and extends on only one side of the electric heater element,
    - the support with the casted mass of composition is fastened in a removable manner on the reception zone.

2. An applicator according to claim 1, the base including a housing that defines the reception zone, at least in part.

3. An applicator according to claim 1, the electric heater element opening out onto the reception zone so as to come into the proximity of the mass of composition, or into contact therewith.

4. An applicator according to claim 1, the mass of the composition lying in a range from 10 mg to 100 mg.

5. An applicator according to claim 1, the support being fastened on the reception zone by snap-fastening, by sliding connection, by magnetization, or by force fitting.

6. An applicator according to claim 1, the support including ridges or a coating of bristles of flock that extend over the mass of composition, at least in part.

7. An applicator according to claim 6, the ridges extending transversally relative to the longitudinal axis of the support.

8. An applicator according to claim 6, the ridges extending parallel to the longitudinal axis of the support.

9. An applicator according to claim 6, the ridges being of the same height.

10. An applicator according to claim 6, at least two of the ridges having heights that are different.

11. An applicator according to claim 10, the heights of the ridges varying in non-monotonic manner on going from one extreme ridge to the other.

12. An applicator according to claim 6, the support including applicator elements that project and are disposed between the ridges.

13. An applicator according to claim 1, the support including applicator elements that project.

14. An applicator according to claim 1, the support being an open-work grid, at least in part.

* * * * *